US005797493A

United States Patent [19]

Watson

[11] Patent Number: 5,797,493

[45] Date of Patent: Aug. 25, 1998

[54] PLUMBING FITTINGS AND METHOD OF PACKAGING THEREFOR

[76] Inventor: Thomas J. Watson, 44 Bershire Mews, N.W., Calgary, Alberta, Canada, T3K 1Z6

[21] Appl. No.: 739,001

[22] Filed: Oct. 28, 1996

Related U.S. Application Data

[60] Provisional application No. 60/005,984 Oct. 27, 1995.

[51] Int. Cl.[6] ..... B65D 85/62

[52] U.S. Cl. ..... 206/443; 206/497; 206/565

[58] Field of Search ..... 206/223, 576, 206/443, 446, 459.5, 775, 497, 499, 557, 565

[56] References Cited

U.S. PATENT DOCUMENTS 3,127,986 4/1964 Hulka ..... 206/223

4,357,961 11/1982 Chick ..... 206/223

4,869,371 9/1989 Dickinson et al. ..... 206/223

5,456,359 10/1995 Horn ..... 206/443

*Primary Examiner*—Jacob K. Ackun

*Attorney, Agent, or Firm*—Weintraub & Brady

[57] ABSTRACT

Plumbing fittings, such as joints, couplings, nipples, etc. are disposed within an opened topped container such that a plurality of the various fittings are disposed within the container. A transparent heat shrinkable film is shrunk onto the opened top container to removably secure the fittings therewithin. Each of the fittings has a removably adhered indicia bearing label secured thereto as well as the container, itself. In this way, the fittings can be sold within the package or may be removed therefrom for individual sales.

3 Claims, 1 Drawing Sheet

FIG 1
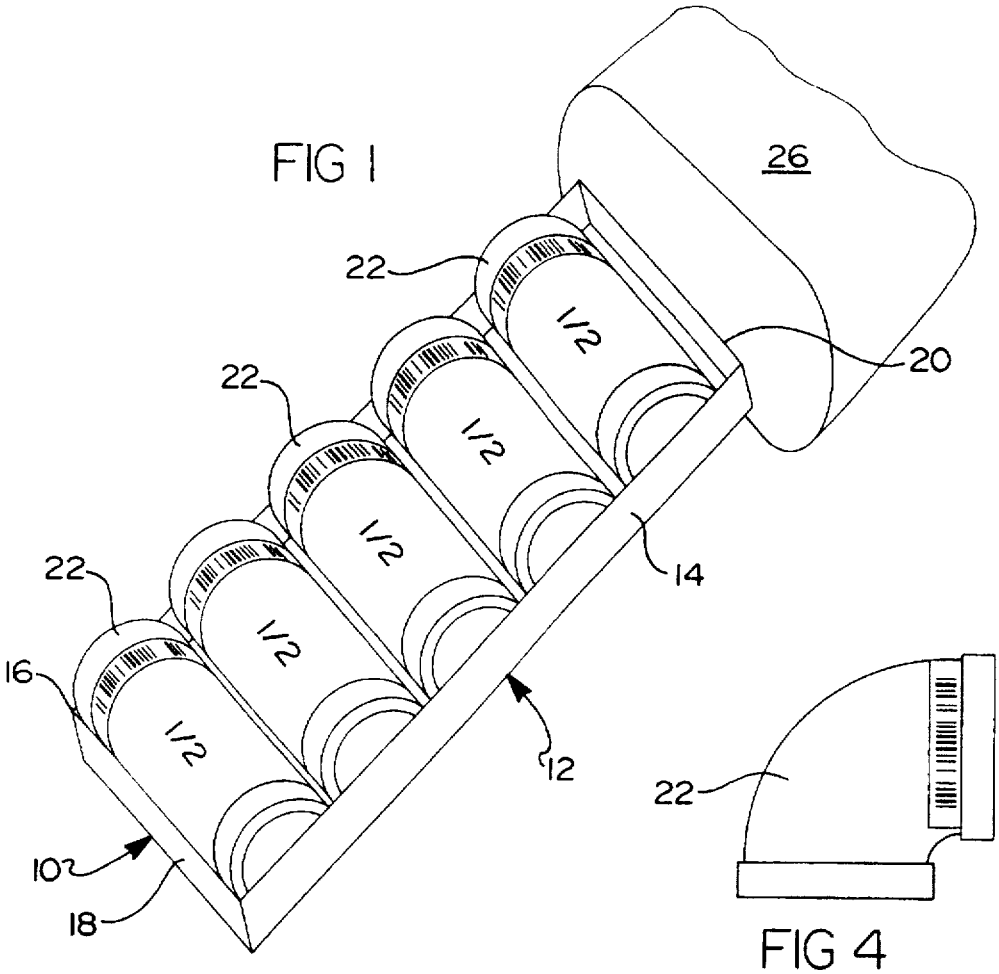
FIG 4
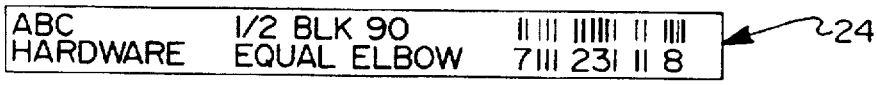
FIG 2
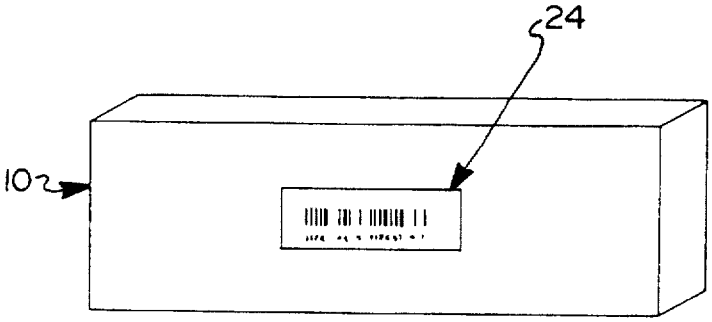
FIG 3

PLUMBING FITTINGS AND METHOD OF PACKAGING THEREFOR

CROSS REFERENCE TO RELATED APPLICATION

This application is a completion application emanating co-pending Provisional patent application Ser. No. 60/005,984, filed Oct. 27, 1995 for "PLUMBING FITTINGS AND METHOD OF PACKAGING THEREFOR", the disclosure of which is hereby incorporated by reference.

BACKGROUND OF THE INVENTION

1. Field of the Invention

The present invention pertains to plumbing fittings. More particularly, the present invention pertains to the packaging of plumbing fittings. Even more particularly, the present invention concerns means and methods for packaging plumbing fittings.

2. Prior Art

Typically, plumbing fittings, such as joints, T-fittings, nipples, elbows and the like are sold to the consumer as individual pieces displayed in bulk or individually displayed, but sorted out by size. When so deployed, they are readily susceptible to marring and dirt accumulation.

Even more difficulty is placed upon the manufacturer who, typically, places the loose fittings in a shipping container which is delivered to the retailer. Because of malleable nature of the material, the parts are readily damaged and dirtied and, thus, often subject to rejection by the customer of the manufacturer. The retailer who receives a bulk shipment must separate by size, individually mark and thereafter place the fittings for display and resale in the manner described above.

Heretofore, to the best of Applicant's knowledge, there has not been provided a package of fittings which, can, if desired, also be sold as individual units.

As detailed hereinafter the present invention attends to this problem.

SUMMARY OF THE INVENTION

In accordance with the present invention there is provided a plumbing fitting and packaging therefor which, generally comprises:

(a) an open topped container having a bottom wall, a pair of opposed, spaced apart, end walls, and a pair of opposed, spaced apart side walls, the container being dimensioned to removably seat therewithin a plurality of plumbing fittings;

(b) a heat shrunk transparent covering enclosing the top of the container;

(c) an indicia bearing label adhered to the exterior of the container, and (d) a plurality of plumbing fittings removably disposed within the container, each fitting including a removable indicia bearing label adhered thereto.

The plumbing fittings may be displayed and sold within the entire container, as packaged, or the heat shrinkable transparent film may be severed and the individual fittings removed therefrom.

For a more complete understanding of the present invention reference is made to the following detailed description and accompanying drawing.

In the drawing like reference characters refer to like parts throughout the several views in which:

BRIEF DESCRIPTION OF THE DRAWING

FIG. 1 is a perspective view of a plurality of plumbing fittings and the packaging therefor in accordance with the present invention;

FIG. 2 is a plan view of a label used for bar coding the fittings;

FIG. 3 is a bottom plan view of a container hereof with a label in place, and FIG. 4 is a side view of an individual fitting with a label affixed thereto.

DESCRIPTION OF THE PREFERRED EMBODIMENT

Referring to the drawing, and in accordance with the present invention there is provided a container, generally, denoted at 10 for a plurality of plumbing fittings. The container 10 has a base 12 and a pair of opposed upstanding sidewalls 14, 16. Opposed end walls 18 and 20 cooperate to define the open top container hereof preferably, the container is a unitary structure and is integrally formed.

Removably disposed within the container 10 are plurality of plumbing fittings, generally, denoted at 22. These devices may include joints, couplings, nipples, etc. The fittings stored within the container may be the same or different, as selected.

Each of the devices 22 has a "bar code" provided thereon. The bar code hereof is imprinted on a removably adhered label or sticker 24 or the like. Such labels have a first indicia bearing side 25 and an adhesive bearing side (not shown) which enables the label to be adhered to the fitting. Preferably, the label 24 is formed from vinyl having an adhesive deposited on side thereof. The label 24 has a length equal to or greater than the circumference of the fitting to enable it to be completely wrapped therearound. As is known to those skilled in the art to which to the present invention pertains, the bar code is a conventional mode to permit electronic scanning for pricing, inventory control and the like for any particular item.

Also, and in accordance with the present invention, a bar code is associated with the container 10. Similarly, as the individual devices, an adhesive backed label or the like may be adhered to the container at any suitably convenient position, such as on the exterior of the base 12, on a side wall or on an end wall. The bar coding, again, contains the desired relevant information.

In order to prevent the devices 22 from falling out of the container 10 a suitable cover such as a shrink wrap plastic 26 is secured around the container and over the devices 22 in the well-known manner. Typically, a thin walled plastic sheet is wrapped around the container with the devices emplaced therewithin. The plastic is then heated to cause a shrinkage thereof to securely emplace the devices within the container. The film may then be cut open or otherwise severed and removed therefrom, when desired, to gain access to the device(s) 22.

By encasing the devices within the container undesired removal therefrom is prevented.

By practicing the present invention it is thus possible to sell multiple devices in a single sale or, if desired, the plastic film may be severed and the individual devices sold separately. This option of selling multiple devices from a single container or being able to sell individual devices, as desired, enables enhanced packaging and point of sales advantages to the consumer.

Having, thus, described the invention what is claimed is:

1. In combination:

(a) an opened toped container having a bottom wall, a pair of opposed end walls, and a pair of opposed, separated side walls, the container being dimensioned to removably seat therewithin a plurality of plumbing fittings;

(b) a heat shrunk transparent covering enclosing the top of the container;

(c) an indicia bearing label adhered to the exterior of the container, and (d) a plurality of plumbing fittings removably disposed within the container, each fitting including a removable indicia bearing label adhered thereto.

2. The container of claim 1 wherein the indicia bearing label is a label having a bar code imprinted thereon to enable electronic scanning thereof.

3. The combination of claim 2 wherein the indicia bearing label disposed on each of the individual fittings is a label having a bar code imprinted thereon.

* * * * *